US009174268B2

(12) United States Patent
Yong et al.

(10) Patent No.: US 9,174,268 B2
(45) Date of Patent: Nov. 3, 2015

(54) METHOD AND APPARATUS FOR FORGING

(75) Inventors: Ming Shyan John Yong, Singapore (SG); Kin Kong Tong, Singapore (SG); Meng Kwong Ho, Singapore (SG); Siew Fei Pook, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 1642 days.

(21) Appl. No.: 11/817,779

(22) PCT Filed: Jun. 20, 2005

(86) PCT No.: PCT/SG2005/000200

§ 371 (c)(1),
(2), (4) Date: Feb. 22, 2011

(87) PCT Pub. No.: WO2006/093469

PCT Pub. Date: Sep. 8, 2006

(65) Prior Publication Data

US 2011/0146364 A1 Jun. 23, 2011

Related U.S. Application Data

(60) Provisional application No. 60/658,171, filed on Mar. 4, 2005.

(51) Int. Cl.
*B21J 9/02* (2006.01)
*B21J 5/02* (2006.01)
(Continued)

(52) U.S. Cl.
CPC .. *B21J 9/02* (2013.01); *B21J 5/025* (2013.01); *B21J 5/027* (2013.01); *B21J 13/02* (2013.01); *B22D 18/02* (2013.01)

(58) Field of Classification Search
CPC ..... B21J 5/02; B21J 5/022; B21J 5/025; B21J 9/02; B21J 13/04; B21C 23/18–23/186; B29C 43/10; B29C 2043/108
USPC ..... 72/352, 353.2, 354.6, 355.2, 355.4, 72/355.6, 356–358, 467, 468, 471, 473, 72/477, 481.2, 57, 60, 264, 267, 453.13; 264/319
See application file for complete search history.

(56) References Cited

U.S. PATENT DOCUMENTS 3,965,716 A * 6/1976 Suzuki et al. ..... 72/356
4,049,040 A 9/1977 Lynch
(Continued)

FOREIGN PATENT DOCUMENTS

CN 1309592 A 8/2001
CN 2659589 Y 12/2004
(Continued)

OTHER PUBLICATIONS

PCT International Search Report and Written Opinion, International Application No. PCT/SG2005/000200; International Filing Date, Jun. 20, 2005; mailing date, Jul. 29, 2005 (6 pp.).
(Continued)

*Primary Examiner* — Shelley Self
*Assistant Examiner* — Pradeep C Battula
(74) *Attorney, Agent, or Firm* — Blakely, Sokoloff, Taylor & Zafman LLP

(57) ABSTRACT

An apparatus for forming an article by forging. The apparatus has at least one die having a die cavity to receive material, said material being at least partially molten, and at least one punch to slidably engage the die cavity and to exert a forming pressure on material disposed in the cavity. There is also at least one pin for forming an article feature. The pin is to slidably engage the die and to contact the material, the pin being further to recede upon exertion of the forming pressure and to exert a feature forming pressure when receded and thereby form the article having the article feature when the material solidifies under the forming pressure.

6 Claims, 7 Drawing Sheets

(51) Int. Cl.
*B22D 18/02* (2006.01)
*B21J 13/02* (2006.01)

(56) References Cited

U.S. PATENT DOCUMENTS

| | | | | | |
|---|---|---|---|---|---|
| 4,352,283 | A | * | 10/1982 | Bailey | 72/355.2 |
| 4,362,043 | A | * | 12/1982 | Hanson | 72/355.4 |
| 4,938,052 | A | * | 7/1990 | Young et al. | 72/361 |
| 5,600,992 | A | * | 2/1997 | Kanazawa et al. | 72/355.4 |
| 5,611,387 | A | | 3/1997 | Chadwick | |
| 6,358,446 | B1 | | 3/2002 | Clarke | |
| 6,619,369 | B2 | | 9/2003 | Takayanagi | |
| 7,171,838 | B2 | * | 2/2007 | Shiokawa | 72/356 |
| 2005/0136223 | A1 | * | 6/2005 | Hoguchi | 264/296 |

FOREIGN PATENT DOCUMENTS

| | | | | | |
|---|---|---|---|---|---|
| GB | 2 075 883 | | | 11/1981 | |
| JP | 04017937 | A | * | 1/1992 | B21K 1/30 |
| JP | 08318359 | | | 12/1996 | |
| JP | 11-169999 | | | 6/1999 | |
| WO | WO 98/43761 | | | 10/1998 | |
| WO | WO 2004/028726 | | | 4/2004 | |

OTHER PUBLICATIONS

Chinese Office Action for counterpart Chinese Application No. CN 2005800496951, 6 pgs., (Dec. 5, 2008).

* cited by examiner

METHOD AND APPARATUS FOR FORGING

CROSS-REFERENCE TO OTHER APPLICTIONS

This is a National Phase of International Application No. PCT/SG2005/000200, filed on Jun. 20, 2005, which claims priority from U.S. Provisional Patent Application No. 60/658,171, filed on Mar. 4, 2005.

FIELD OF THE INVENTION

This invention relates to forging, in particular to a method and apparatus for forming articles having complex shapes and homogenous structures.

BACKGROUND OF THE INVENTION

Traditional liquid forging or squeeze casting produces metallic articles with a fine-grained microstructure by exerting a high pressure on at least partially molten metal during solidification. The articles formed have a high density and are ideally porosity-free. For example, on a punch die that moves into a female die to fully enclose a charge of at least partially molten metal, the at least partially molten metal solidifies into an article under external pressure continuously exerted by a hydraulic press on the punch die. Squeeze casting or liquid forging also reduces hot tearing or cracking in an article, effects which arise due to melt shrinkage during cooling. Such melt shrinkage can be compensated for by applying an oscillating squeeze pressure during solidification or by means of double acting pressure to improve article strength and toughness.

The actual volume of the article obtained depends on the quantity of at least partially molten metal supplied. To obtain articles having predetermined dimensions regardless of varying amounts of access of at least partially molten metal, a compensating pressure can be exerted through the cavity base. This compensating pressure allows excess material, which varies in volume from article to article, to extend beyond actual article dimensions. After ejection of the article, solidified excess material is trimmed off.

Current techniques are appropriately suited to the production of strong and tough articles having relatively simple shapes. However, more complex shapes require tighter dimensioning tolerances, which existing techniques are unable to achieve. For example, thinner sections tend to prematurely solidify, resulting in greater porosities in the thinner sections compared to the rest of the article, which leads to a non-homogenous structure. At the same time, current liquid forging or squeeze casting techniques as yet have no capability to form parts having relatively small through holes of fine tolerances. However, complex articles also often require homogeneously high strength and toughness, properties which are in themselves readily achieved by forging.

Also, when dealing with thin wall sections, quite often the grain size may be close to the same order of magnitude as the wall thickness. In that case a loss of one grain may cause a significant reduction in wall thickness and wall strength. For example, the grain size may be 100 microns and the wall may be 300 microns thick. This is important in small products such as, for example, the casings for small disk drives.

SUMMARY OF THE INVENTION

According to a first preferred aspect there is provided an apparatus for forming an article. The apparatus comprises at least one die having a die cavity to receive material, said material being at least partially molten and at least one punch adapted to slidably engage the die cavity and to exert a forming pressure on material disposed in the die cavity. There is also at least one pin for forming an article feature. The pin is adapted to slidably engage the die and to contact the material, the pin being further adapted to recede upon exertion of the forming pressure and to exert a feature forming pressure when receded and thereby form the article having the article feature when the material solidifies under the forming pressure.

According to a second aspect there is provided a method of forming an article having an article feature. The method comprises:

(a) locating at least one pin at a first position relative to a die cavity;

(b) inserting into the die cavity a molten material to be used to form the article;

(c) moving a punch relative to the die cavity to contact the molten material to form the article; and (d) moving the at least one pin to a second position relative to the die cavity, the movement of the at least one pin being prior to solidification of the molten material.

The pin may be in contact with the punch when the material solidifies; or may be receded out of the die cavity when the material solidifies.

The feature forming pressure may be less than the forming pressure; and the movement of the at least one pin may be in consequence of the movement of the punch. The punch may contact the at least one pin prior to the punch contacting the molten material. When the punch contacts the at least one pin, the punch may force the pin from a first position to a second position. Alternatively, or additionally, the pin may be moved from the first position to the second position by the molten material in consequence of a compressive force applied to the molten material by the punch.

When the at least one pin is in the first position, an upper end of the at least one pin may be substantially co-planar with a lower surface of the die cavity. When the at least one pin is in the second position, the upper end of the pin may be recessed below the lower surface.

Alternatively or additionally, when the at least one pin is in the first position and the molten material is inserted in the die cavity, an upper end of the at least one pin may be located above a top surface of the molten material.

BRIEF DESCRIPTION OF THE DRAWINGS

In order that the present invention may be fully understood and readily put into practical effect, there shall now be described by way of non-limitative example only preferred embodiments of the present invention, the description being with reference to the accompanying illustrative drawings.

In the drawings.

DETAILED DESCRIPTION OF THE PREFERRED EMBODIMENTS

Figure 1:
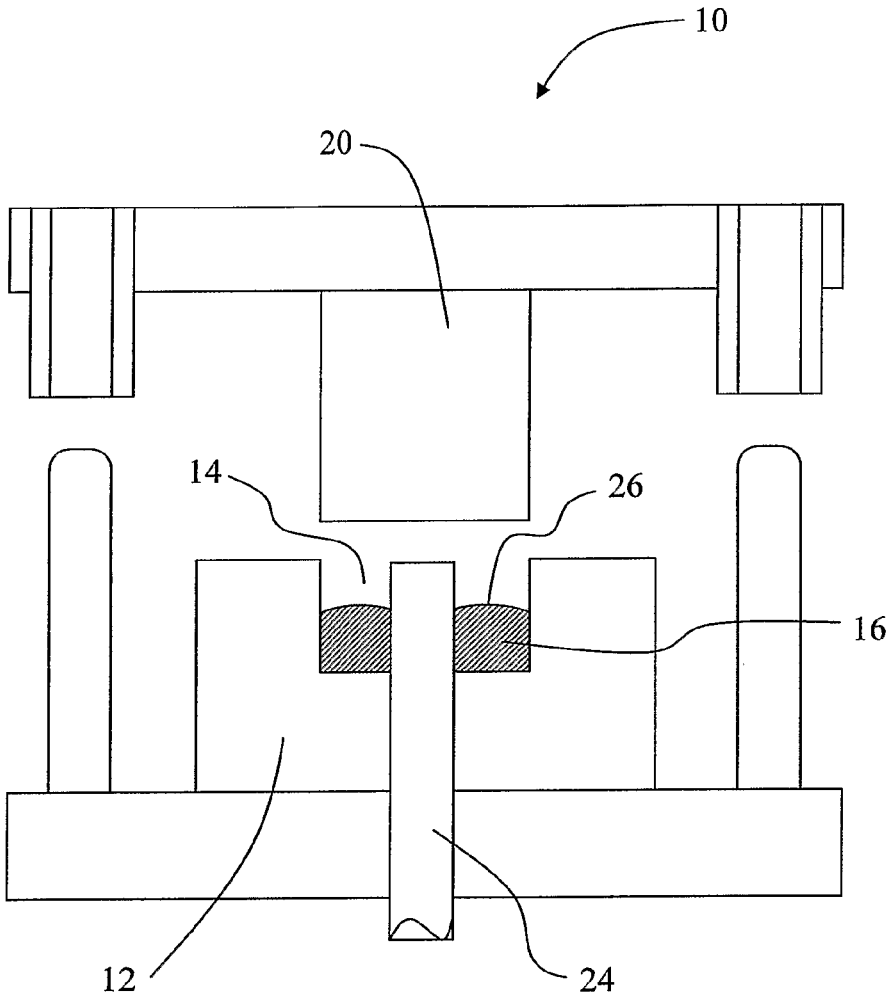
FIG. 1 is a sectional view of a first embodiment prior to exertion of a forming pressure.

According to one aspect, there is provided a forging apparatus for forming at least one article. The article formed by this apparatus can comprise through holes and thin sections while having a homogenous structure.

Referring to the drawings, the apparatus 10 comprises a die 12 having a die cavity 14 to receive material 16 that is at least partially molten. For example, the material 16 can be a fully molten metal, a semi-solid metal, or a composite material having a liquid or a semi-solid metallic phase.

The apparatus includes a punch 20 that is adapted to engage the die cavity 14 with a sliding but generally sealing fit, and to exert a forming pressure on material 16 disposed in the die cavity 14. For example, the forming pressure can be provided by means of a hydraulic press.

The apparatus 10 also comprises a pin 24 for forming an article feature. The apparatus 10 is such that the pin 24 engages the die 12 with a sliding fit. The pin 24 can extend into the die cavity 14 to contact the material 16, as well as recede outside of the die cavity 14. The pin 24 is also configured to exert a feature forming pressure, and to be able for form a feature in the moulded product.

In a first embodiment, as shown in FIG. 1, material 16 is disposed in the die cavity 14. Material 16 is inserted into the die cavity 14 after pin 24 has been extended until it contacts punch 20, or is at least above the anticipated surface level 26 of the material 16. This is a first position of the pin 24. Therefore, the pin 24 initially extends above the surface level 26 of the material 16 when material 16 is inserted into cavity 14. As the punch 20 approaches the material 16 and exerts the forming pressure, the punch 20 contact and applies a force to the pin 24 before contacting the material 16. That force is sufficient to overcome the force being applied to pin 24 to move and retain it in the extended or first position shown. The pin 24 correspondingly recedes while exerting the feature forming pressure. The feature forming pressure is typically less than the forming pressure, and can be provided by the same hydraulic press, for example. Alternatively, it may be substantially the same as the forming pressure. When punch 20 contacts the material 16 it applies the forming pressure to the material to compress the material to form the article and, in combination with the pin 24, to form the feature. When the punch 20 ceases movement, the pin 24 is in a receded or second position.

Figure 2:
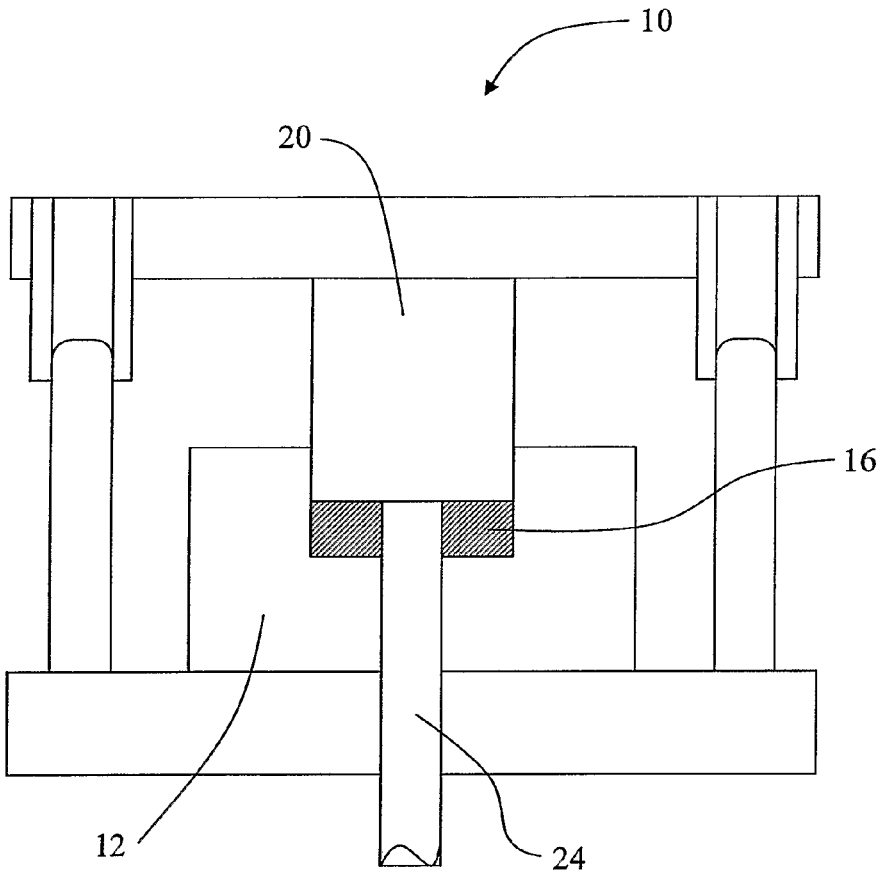
FIG. 2 is a vertical cross-sectional view corresponding to FIG. 1 of the first embodiment during exertion of the forming pressure.
Figure 3:
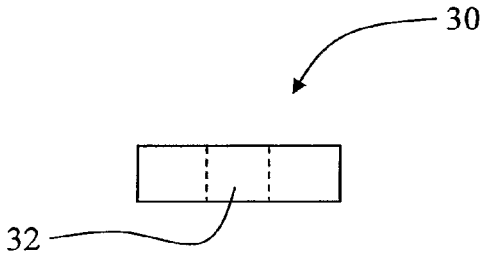
FIG. 3 is a side view of an article formed according to the first embodiment.

Solidification of the material 16, as shown in FIG. 2, results in an article 30, as shown in FIG. 3. In the first embodiment, the article feature is a through hole 32. For example, the pin 24 can have a circular cross-section, such that the through hole 32 is circular. The pin 24 can have a different cross-section, or a plurality of different cross-sections along its length, depending on the desired shape of the through hole 32.

In this way the material 16 remains liquid for a sufficient period to enable the article features to be formed before solidification. It also minimizes the risk of premature solidification—i.e. before punch 20 applies its force to material 16. This assists in allowing the material 16 to adopt a more uniform and homogenous structure, and to reduce grain size.

Furthermore, if pin 24 were moved after material 16 was inserted into die cavity 14, it may have to penetrate a skin formed on material 16 around cavity 14. Penetrating the skin may affect pin 24, the article feature, and the structure of the material 16 after solidification. After punch 20 contacts material 16, the material 16 solidifies quite rapidly due to thermal transfer to and through punch 26.

Figure 4:
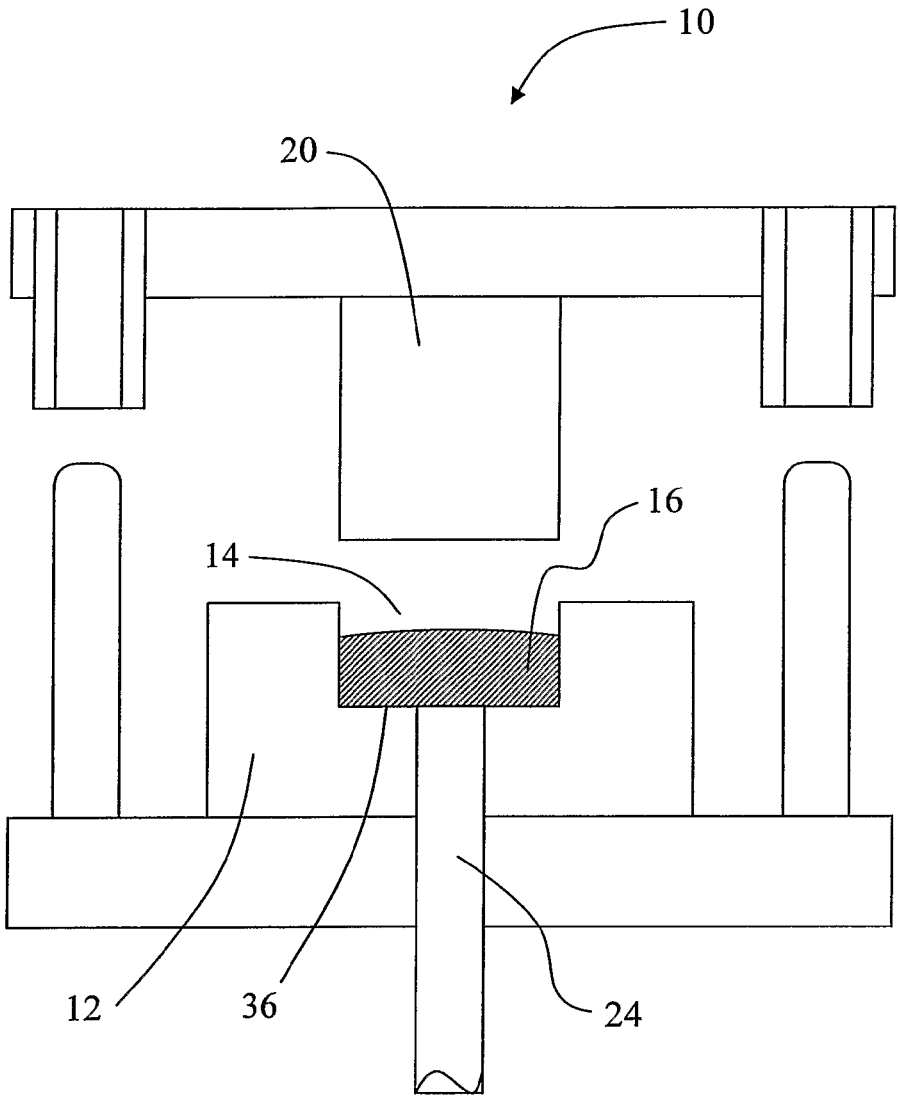
FIG. 4 is a vertical cross-sectional view of a second embodiment prior to exertion of a forming pressure.
Figure 5:
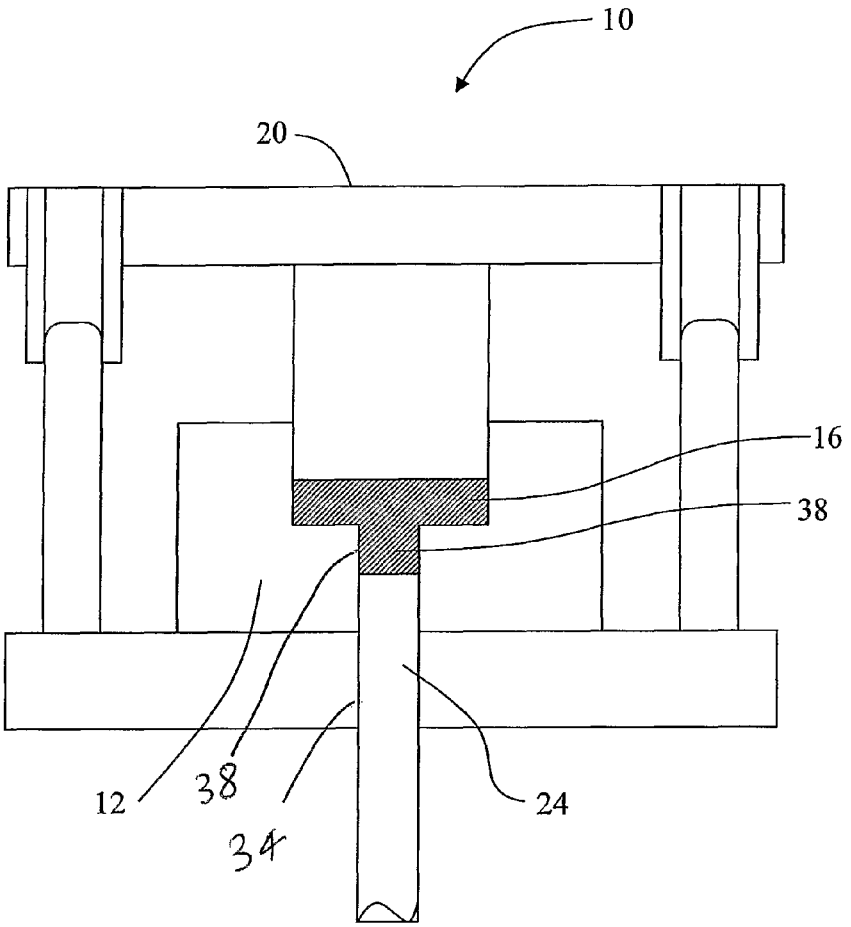
FIG. 5 is a view corresponding to FIG. 4 of the second embodiment during exertion of the forming pressure.

In a second embodiment, as shown in FIG. 4, material 16 is disposed in the die cavity 14. Before material 16 is inserted into die cavity 14, the pin 24 is initially flush with a lower surface 36 of the die cavity 14 and does not extend into the die cavity 14. This is the first position of the pin 24. When material 16 is inserted into die cavity 14, and referring to FIG. 5, as the punch 20 exerts a forming pressure on the material 16, pressurized material 16 causes the pin 24 to recede out of the die cavity 14 in bore 34. At the same time, the pin 24 exerts a feature forming pressure on the material 16. As the pin 24 recedes, the material 16 extrudes into the space 38 previously occupied by the pin 24 before receding. When the pin 24 has moved or receded sufficiently, it stops at its second, or receded, position (FIG. 5). By maintaining the pressure on material 16 between pin 24 and punch 20, the feature is created by material 16 filling bore 34 to the top of pin 24, and the material filling bore 34 is homogenous with the remainder of material 16.

Figure 6:
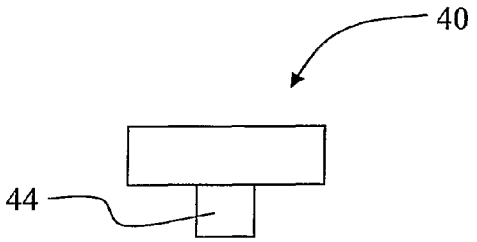
FIG. 6 is a side view of an article formed according to the second embodiment.

Solidification of the material 16, as shown in FIG. 5, results in formation of an article 40, as shown in FIG. 6. In the second embodiment, the article feature is neck 44. For example, the pin 24 can have a thin cross-section such that the neck 44 is a thin section. Problems associated with premature solidification of the neck 44 are reduced, since solidification takes place under pressure provided by both the punch 20 and the pin 24. The structure of the neck 44 is thus homogenous with the rest of the article 40. The pin 24 can have a different cross-section, or a plurality of different cross-sections along its length, depending on the desired shape of the neck 44.

Figure 7:
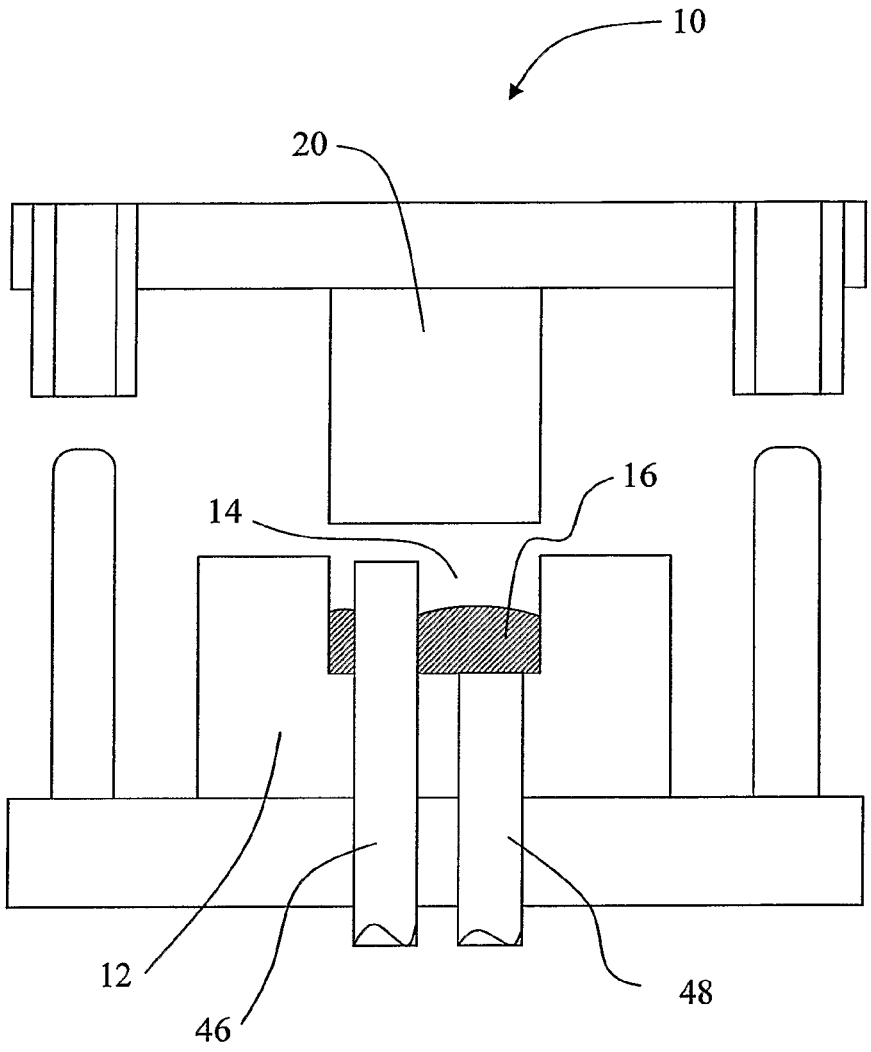
FIG. 7 is a vertical cross-sectional view of a third embodiment prior to exertion of a forming pressure.
Figure 8:
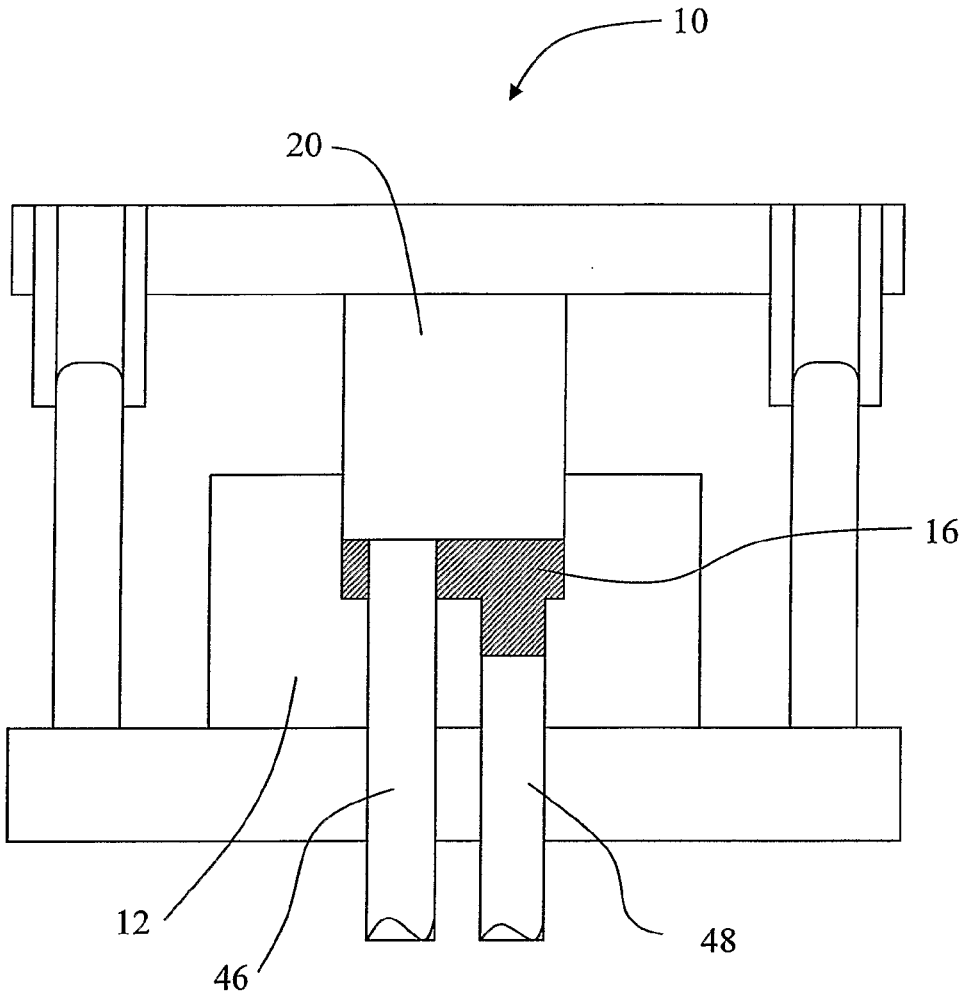
FIG. 8 is a view corresponding to FIG. 7 of the third embodiment during exertion of the forming pressure.
Figure 9:
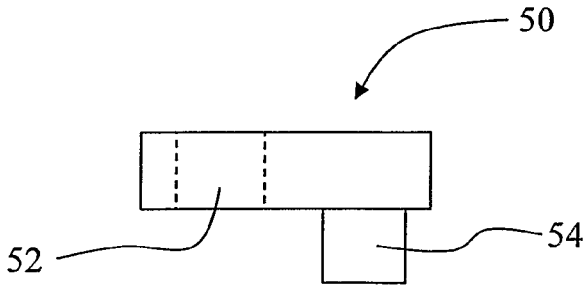
FIG. 9 is a side view an article formed according to the third embodiment.

In a third embodiment, the apparatus 10 includes two pins 46, 48, as shown in FIG. 7. In the third embodiment, one of the pins 46 is configured and operates according to the pin 24 of the first embodiment, while the other pin 48 is configured and operates according to the pin 24 of the second embodiment. Upon exertion of the forming pressure by the punch 20 on material 16 disposed in the die cavity 14, solidification of the material 16, as shown in FIG. 8, results in the formation of an article 50, as shown in FIG. 9. In the third embodiment, two article features, a through hole 52 and neck 54, are formed. In the third embodiment, the article 50 combines the features and processes of the first embodiment and the second embodiment.

Although the embodiments described depict one punch and one die, other embodiments which combine a varied plurality of dies, punches and pins configured similarly to the embodiments earlier described can be provided to form a plurality of articles having multiple article features. These features may be holes, protrusions, necks, recesses, or a combination of them. Such articles and article features can be of various shapes and sizes. Articles of complex shapes and homogenous structures can thus be formed. Furthermore, the surfaces of pins 24, 46, 48 and/or punch 20 may have surface treatments to from further, complex or compound features.

Figure 10:
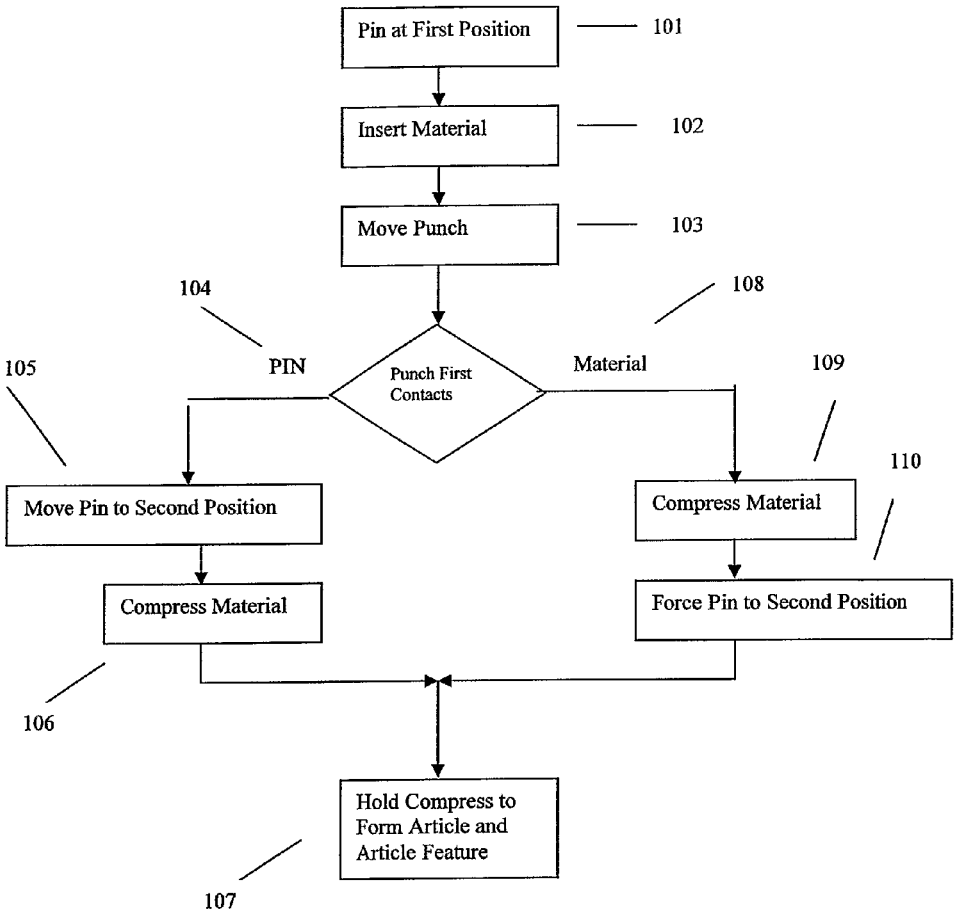
FIG. 10 is a flow chart of the process.

FIG. 10 illustrates the processes described above. The pin 24 is in a first position at the start of the process (101). This will be the position shown in FIGS. 1, 4 and 7. The material 16 is then inserted (102) and the punch 20 moved (103). If the punch 20 contacts pin 24 before material 16 (i.e. FIGS. 1 to 3, 7 to 9) (104), the punch 20 moves pin 16 to the second position (105) and compresses the material 16 (106) to form the article and the article feature (107). If the punch 20 contacts material 16 first (108) (FIGS. 4 to 6, 7 to 9) it compresses the material (109) to force the pin 24 to the second position (110) to form the article and the article feature (107).

Whilst there has been described in the foregoing description preferred embodiments of the present invention, it will be understood by those skilled in the technology concerned that many variations or modifications in details of design or construction may be made without departing from the present invention.

What is claimed is:

1. A method of forming an article having an article feature, the method comprising:

(a) locating at least one pin at a first position relative to a die cavity;

(b) inserting into the die cavity a molten material to be used to form the article;

(c) moving at least one punch relative to the die cavity to contact the molten material to form the article; and (d) moving the at least one pin to a second position relative to the die cavity, the movement of the at least one pin being prior to solidification of the molten material, wherein the movement of the at least one pin is a consequence of the movement of the at least one punch; and wherein the at least one punch contacts the at least one pin prior to the at least one punch contacting the molten material.

2. The method as claimed in claim 1, wherein after the at least one punch contacts the at least one pin, the at least one punch forces the pin from the first position to the second position.

3. The method as claimed in claim 2, wherein, when the at least one pin is in the first position and the molten material is inserted in the die cavity, an upper end of the at least one pin is located above a top surface of the molten material.

4. The method as claimed in claim 1, wherein the at least one pin includes a second pin, the second pin is moved from a third position relative to the die cavity to a fourth position relative to the die cavity by the molten material in consequence of a forming pressure applied to the molten material by the punch.

5. The method as claimed in claim 4, wherein, when the second pin is in the third position, an upper end of the second pin is substantially co-planar with a lower surface of the die cavity.

6. The method as claimed claim 5, wherein, when the second pin is in the fourth position, the upper end of the second pin is receded below the lower surface.

* * * * *